US007793392B2

(12) United States Patent
Henderson et al.

(10) Patent No.: US 7,793,392 B2
(45) Date of Patent: Sep. 14, 2010

(54) COMPOUND BUCKLE

(75) Inventors: Scott Henderson, Brooklyn, NY (US); Ellen D. Diamant, New York, NY (US); Michael E. Diamant, New York, NY (US); Scott D. Kolasa, Mt. Prospect, IL (US)

(73) Assignee: Skip Hop, Inc., New York, NY (US)

( * ) Notice: Subject to any disclaimer, the term of this patent is extended or adjusted under 35 U.S.C. 154(b) by 292 days.

(21) Appl. No.: 11/896,968

(22) Filed: Sep. 7, 2007

(65) Prior Publication Data

US 2009/0064466 A1 Mar. 12, 2009

(51) Int. Cl.
*A44B 11/25* (2006.01)
*A44B 11/24* (2006.01)

(52) U.S. Cl. ..... 24/630; 24/614; 24/629

(58) Field of Classification Search ..... 24/630, 24/615, 614, 182, 197, 177, 625, 629
See application file for complete search history.

(56) References Cited

U.S. PATENT DOCUMENTS

| | | | | |
|---|---|---|---|---|
| 3,491,414 | A * | 1/1970 | Stoffel | 24/632 |
| 3,523,342 | A | 8/1970 | Spires | |
| 5,438,737 | A * | 8/1995 | Anscher et al. | 24/630 |
| 5,659,931 | A | 8/1997 | Anscher | |
| 5,996,192 | A * | 12/1999 | Haines et al. | 24/625 |
| 6,052,875 | A | 4/2000 | Fudaki | |
| 6,148,486 | A | 11/2000 | Uehara et al. | |
| 6,351,876 | B1 | 3/2002 | Uehara | |
| 6,463,638 | B1 * | 10/2002 | Pontaoe | 24/614 |
| 6,622,355 | B2 | 9/2003 | Buscart et al. | |
| D524,693 | S | 7/2006 | Uehara et al. | |
| D524,694 | S | 7/2006 | Funo et al. | |
| D535,212 | S | 1/2007 | Pontaoe | |
| D535,213 | S | 1/2007 | Kolasa | |
| D535,214 | S | 1/2007 | Kolasa | |
| 2006/0277727 | A1 | 12/2006 | Keene | |
| 2009/0094810 | A1 * | 4/2009 | Rouhana et al. | 24/630 |

FOREIGN PATENT DOCUMENTS

| | | |
|---|---|---|
| EP | 1 205 123 | 5/2002 |

* cited by examiner

*Primary Examiner*—Victor Batson
*Assistant Examiner*—Michael Lee
(74) *Attorney, Agent, or Firm*—Stites & Harbison PLLC; Stephen J. Weyer

(57) ABSTRACT

A compound buckle comprises a socket member and at least two plug members, wherein the socket comprises individual cavities for each plug member, and a projection comprising a slot, and wherein each plug member comprises a base, a projection comprising a slot, and at least one arm portion also projecting from said base, wherein each plug member may be independently inserted/removed from its cavity without interfering in the operation of any other plug member and without degrading the performance of any belt, strap or other assembly connected by said other plug member.

10 Claims, 6 Drawing Sheets

Fig. 3a
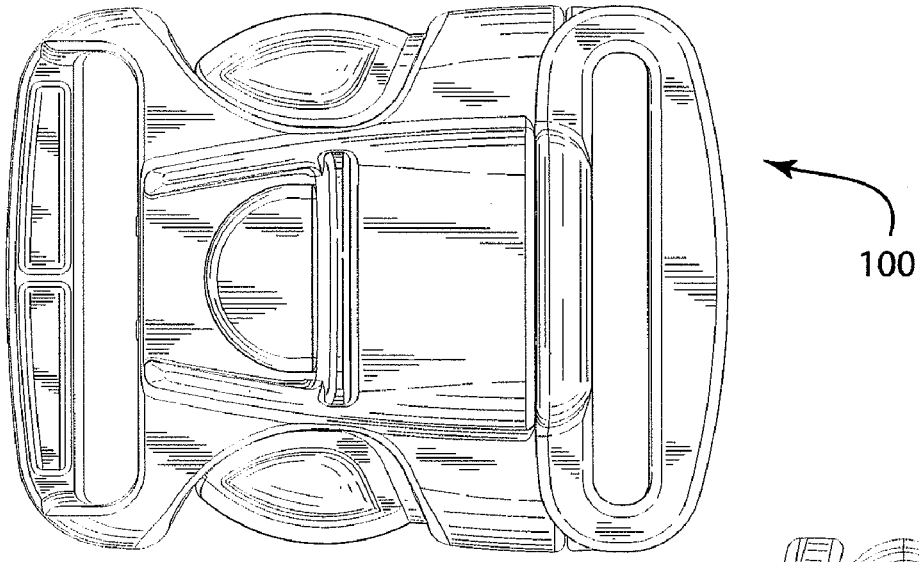
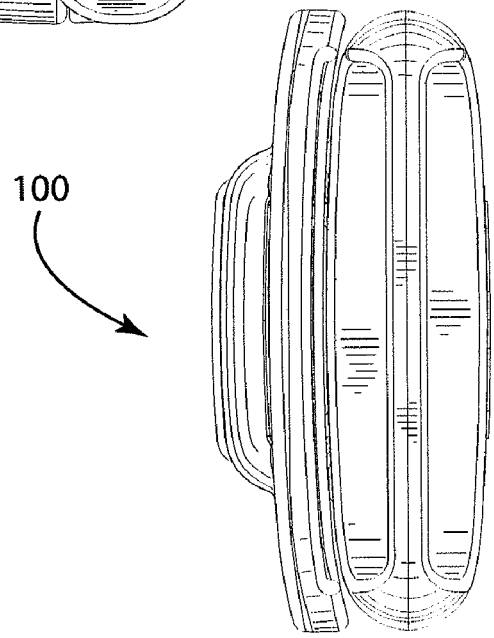
Fig. 3b
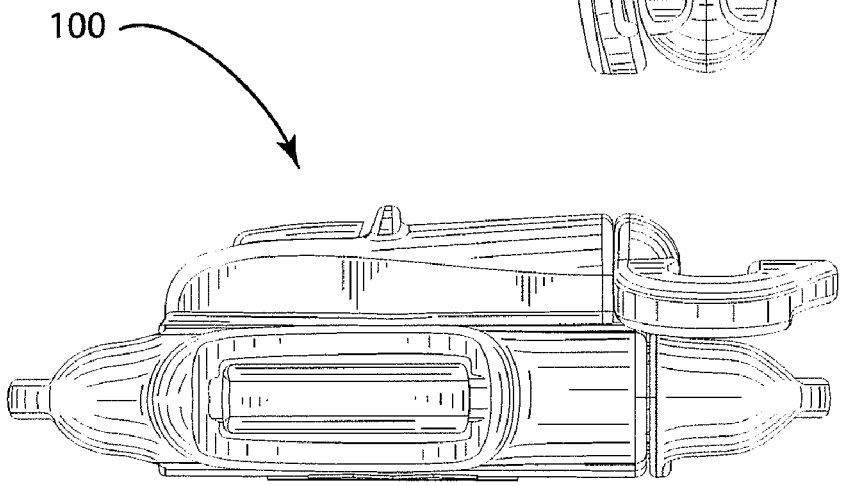
Fig. 3c

COMPOUND BUCKLE

FIELD OF THE INVENTION

This invention relates to a buckle assembly for use in releasably joining loose ends of belts or straps secured to garments, bags, helmets, sports gears and the like.

BACKGROUND OF THE INVENTION

Buckles of various structures are well known, each of which is comprised of a female member composed of a socket member and a male member composed of a plug member. Speaking of its basic structure, the socket member has engaging faces, while the plug member comprises arm portions which are adapted to be releasably inserted into the socket member, wherein engaging portions on the arm portions engage and disengage from the engaging faces of the socket member. Each socket member and plug member has a base portion at one side end thereof. Each base portion either has an integral slot, or a projection therefrom which when combined with the base portion forms a slot through which a strap or belt may be inserted and/or affixed therein. By engaging/disengaging the plug member from the socket member, the ends of a strap/belt can be connected to or disconnected from each other or to some other common element.

When an external force is applied to the exposed surfaces of the plug member which project out through the walls of the socket member, the forces resiliently deform the arms of the plug members causing them to disengage from the walls of the socket member. Therefore the plug member is easy to slip out of the socket member.

Additionally, there are buckles known in the art which offer a central cavity wherein multiple plug members are mutually inserted, such as the commonly called "five-point" harness of a child's car seat. However these devices are constructed to only work properly when all of the plugs are engaged—they fail, or can fail, in the performance of the design function if any plugs are not engaged.

SUMMARY OF THE INVENTION

The invention comprises several general aspects. Each of those can if desired be combined with additional features, including features disclosed and/or not disclosed herein, the resultant combinations representing more detailed optional embodiments of these aspects.

A first aspect of the invention is a buckle comprising a single socket member and at least two plug members. The socket member has a base. The base may have an integral through-slot, or may have at least one projecting member projecting from said base which when combined with the base comprises at least one slot through which at least one strap may be affixed. The socket member may have a separate cavity for each plug member, and each cavities comprises a top wall, a bottom wall, and right and left side walls for connecting said top wall and said bottom wall with a gap therebetween, and openings communicating with said cavity inside the socket member and disposed inside from said side walls.

The plug members have a base and at least one arm portion projecting from said base. The base of the plug member may have an integral through-slot, or may have at least one projecting member projecting from said base which when combined with the base comprises at least one slot through which at least one strap may be affixed.

The arm portion of a plug member may have an engaging portion at a leading end thereof. In use, the plug member is adapted to be resiliently deformed when inserted into/released from a cavity of said socket member so that a hooking face of the engaging portion of said arm portion releasably engages an end face of each an opening in a cavity. The plane of contact between the engaging portion of the arm portion and the end face of the cavity is perpendicular to plane of motion of the insertion/release direction of said arm portion.

A first plug member may be releasably engageable when inserted into a first cavity of said socket member, and at least one other plug member may be releasably engageable when inserted into at least one other cavity of said socket member. Said first and said at least one other plug member are independently operable without interfering with one another.

The operation of one or more plug members does not degrade the performance of any other plug members, nor the functionality of any strap, belt or other assembly connected to said other plug members, nor of any devices connected via said straps or belts.

In certain embodiments a first plug member and at least one other plug member may be the same in either or both form and functionality. In other embodiments a first plug member and at least one other plug member may be differ in either or both form and functionality.

In some embodiments a first cavity the socket member and at least one other cavity may be substantially parallel to one another. In other embodiments a first cavity the socket member and at least one other cavity may be substantially perpendicular to one another.

In yet other embodiments, irrespective of the orientation of the cavities, a first cavity and at least one other cavity may be positioned side-by-side, or may be stacked one above the other.

The following discussion of advantages is not intended to limit the scope of the invention, nor to suggest that every form of the invention will have all of the following advantages. As will be seen from the remainder of this disclosure, the present invention provides a variety of features. These can be used in different combinations. The different combinations are referred to as embodiments. Most embodiments will not include all of the disclosed features. Some simple embodiments can include a very limited selection of these features. Those embodiments may have only one or a few of the advantages described below. Other preferred embodiments will combine more of these features, and will reflect more of the following advantages. Particularly preferred embodiments, that incorporate many of these features, will have most if not all of these advantages. Moreover, additional advantages, not disclosed herein, that are inherent in certain embodiments of the invention, will become apparent to those who practice or carefully consider the invention.

The foregoing and other objects of the invention are achieved by the apparatus described herein which overcome problems inherent in traditional buckles. Those problems include limitations on the number, connection and orientation of plugs which can engage a socket member, and the inability to operate a single plug (and any connected belts or straps, an any devices or assemblies engaged via said belts or straps) without degrading the performance of an overall system, or without interfering with the operation of any other plug.

Thus, when compared to other buckles several new and important advantages. The advantages offered by the various embodiments of this invention include:

Independent operation of any plug. Each device attached via a plug can be independently operated without degrading the functionality of any other device attached via any other plug.

Non-interference. Each plug can be inserted/deleted without interfering with the operation of any other plug.

Multiple independent cavities which can engage multiple plugs. Any cavity or plug that becomes damaged or inoperable does not degrade the performance of any other plug or cavity.

Use of multiple identical plugs in different locations and/or orientations. A single device can be connected via a strap or belt affixed to a plug, and can be moved to different locations Use of different plugs. Each plug is instantly recognizable.

BRIEF DESCRIPTION OF THE DRAWINGS

FIG. 3*a* is a top plan view of the compound buckle of FIG. 1, FIG. 3*b* is a front elevational view of the compound buckle of FIG. 1, and FIG. 3*c* is a side elevational view of the compound buckle of FIG. 1;

DETAILED DESCRIPTION

Figure 1:
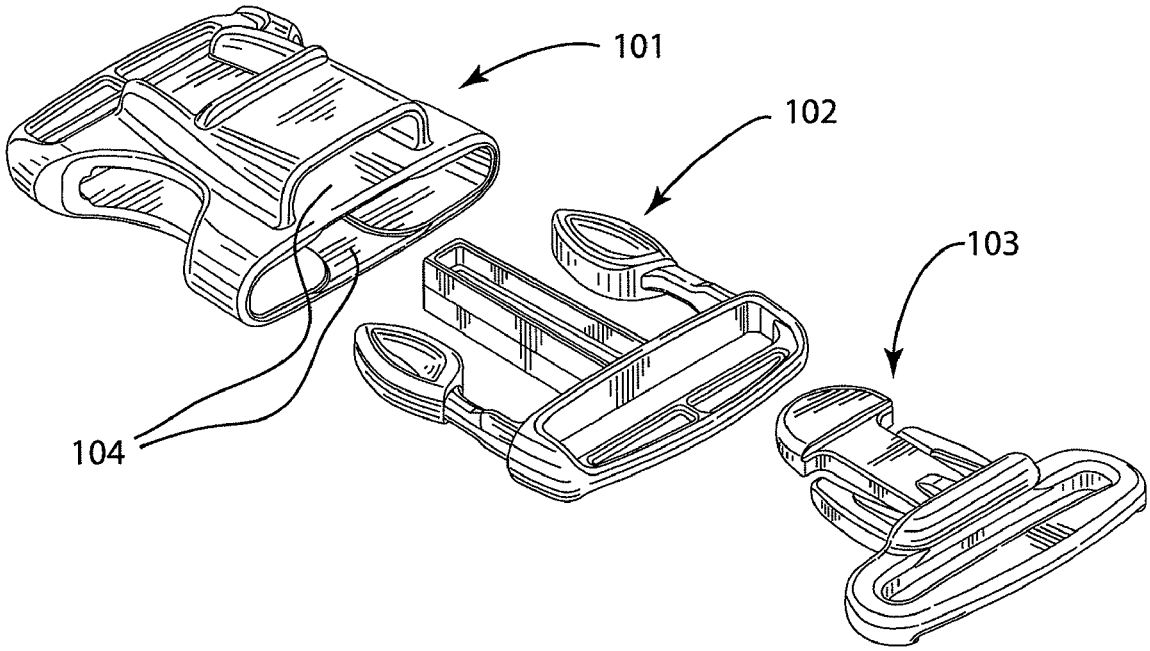
FIG. 1 is a perspective view of component parts of a compound buckle, in accordance with the present invention, shown in an exploded view.
Figure 2:
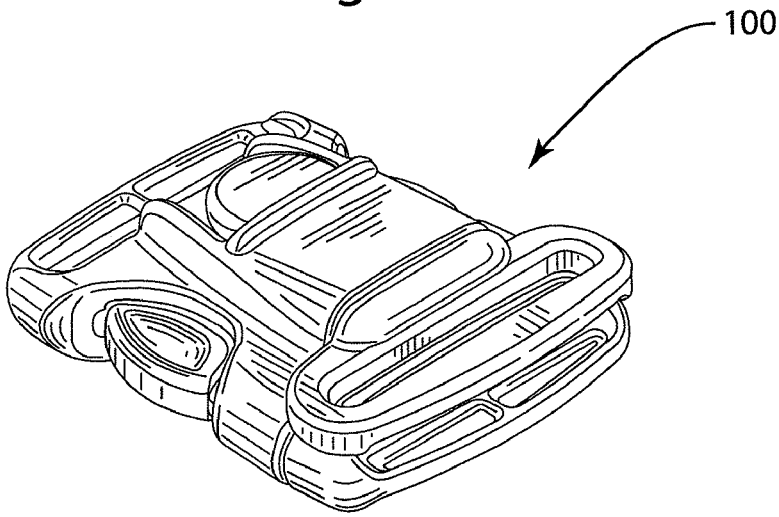
FIG. 2 shows the compound buckle of FIG. 1 in its assembled state.

FIG. 1 through 3 illustrate a version of a compound buckle 100, comprising a socket member 101, and two plug members 102 and 103, wherein the plug members are of different form and functionality.

FIG. 1 shows an exploded view of the component parts of the compound buckle; FIG. 2 shows the same components as assembled, with plug members 102 and 103 inserted into appropriate cavities 104 of socket member 101.

FIG. 3 is a schematic representation of compound buckle 100 showing top (3*a*), front (3*b*) and side (3*c*) elevational views.

FIGS. 4 through 10 illustrate some of the various alternative configurations for the present invention's compound buckle (buckles 200 and 300), wherein the plugs (202 and 302) for use with their respective sockets (201 and 301) are identical in both form and function.

Figure 4:
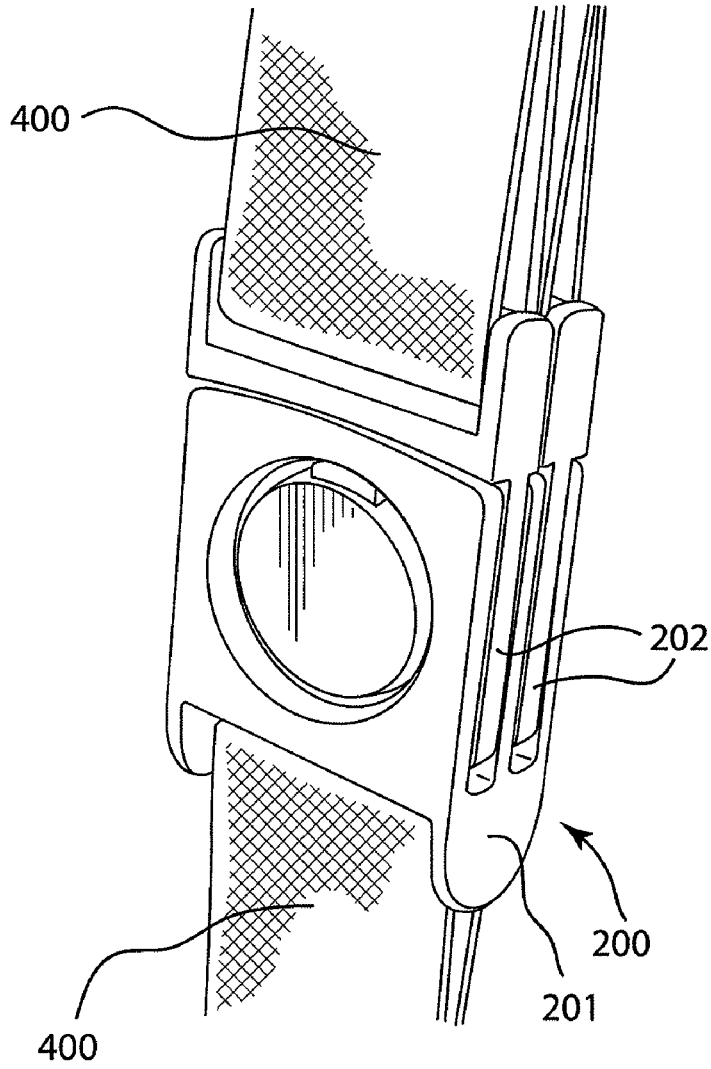
FIG. 4 is a front isometric elevational view of another compound buckle, in accordance with the present invention.
Figure 5:
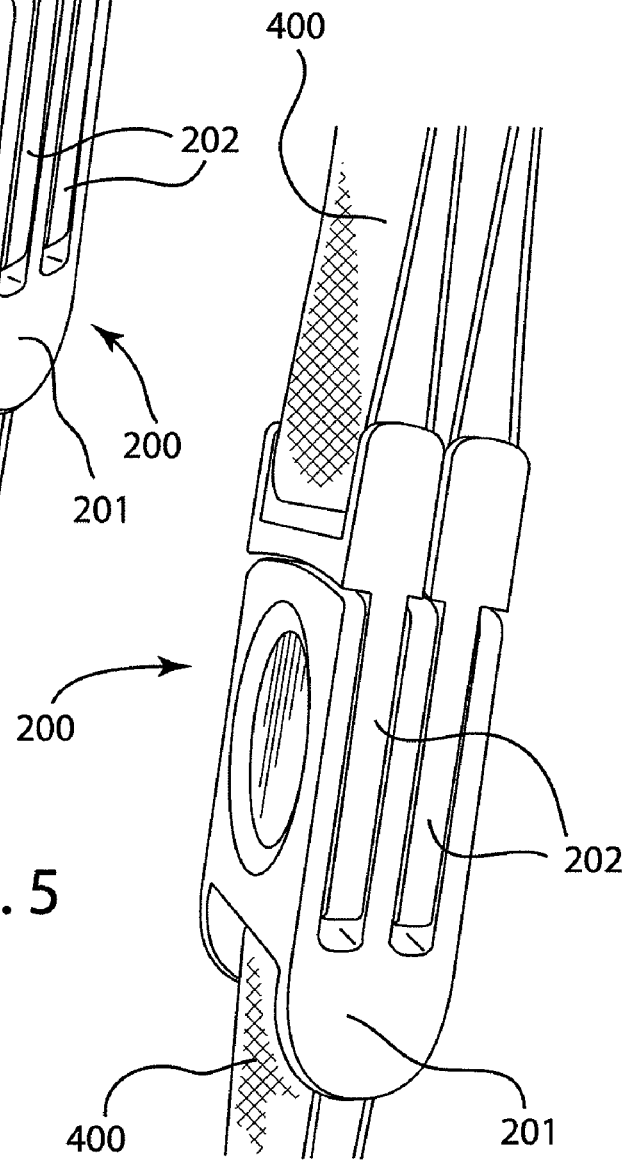
FIG. 5 is a side isometric elevational view of the compound buckle of FIG. 4.

FIGS. 4 and 5 are front and side isometric elevational views, respectively, of compound buckle 200, comprising socket member 201, and plug members 202, from which are connected various straps 400.

Figure 6:
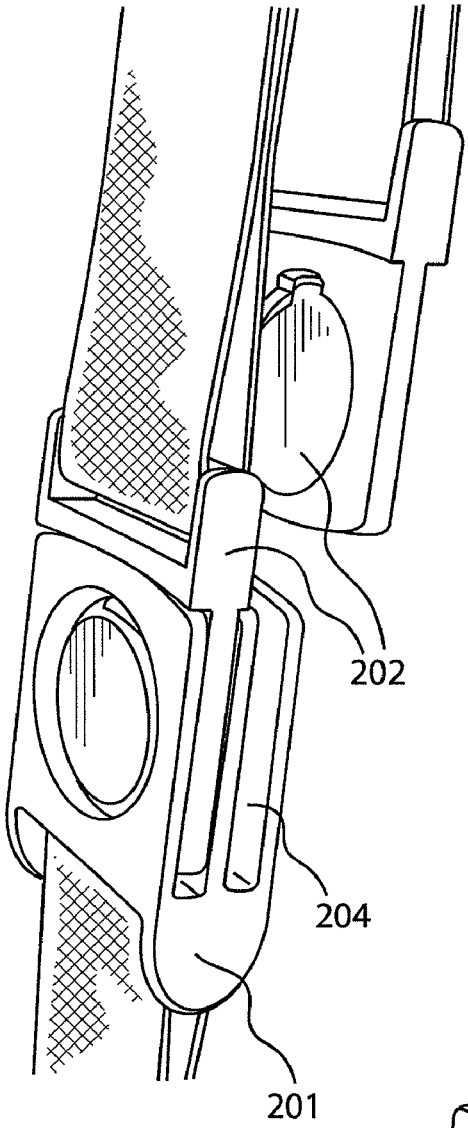
FIG. 6 is a side elevational view of the compound buckle of FIG. 4, shown in a partially disengaged state.
Figure 7:
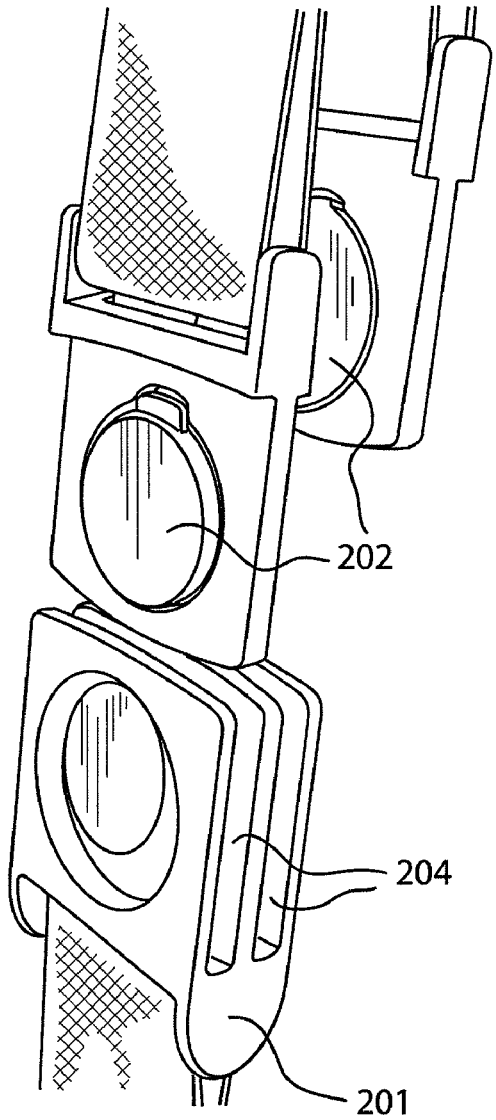
FIG. 7 is an elevational view of the buckle of FIG. 4, shown in a completely disengaged state, in accordance with the present invention.

FIGS. 6 and 7 detail the operation of a first plug member 202, which can be independently disengaged from socket member 201 without interfering with the operation or stability of the remaining plug member 202. In FIG. 6, the first plug member 202 is removed while a second plug member 202 remains engaged with the socket member 201. In FIG. 7, both plug members 202 are disengaged, revealing the discrete cavities 204 for each of the plug members 6.2.2 FIGS. 8-10

Figure 8:
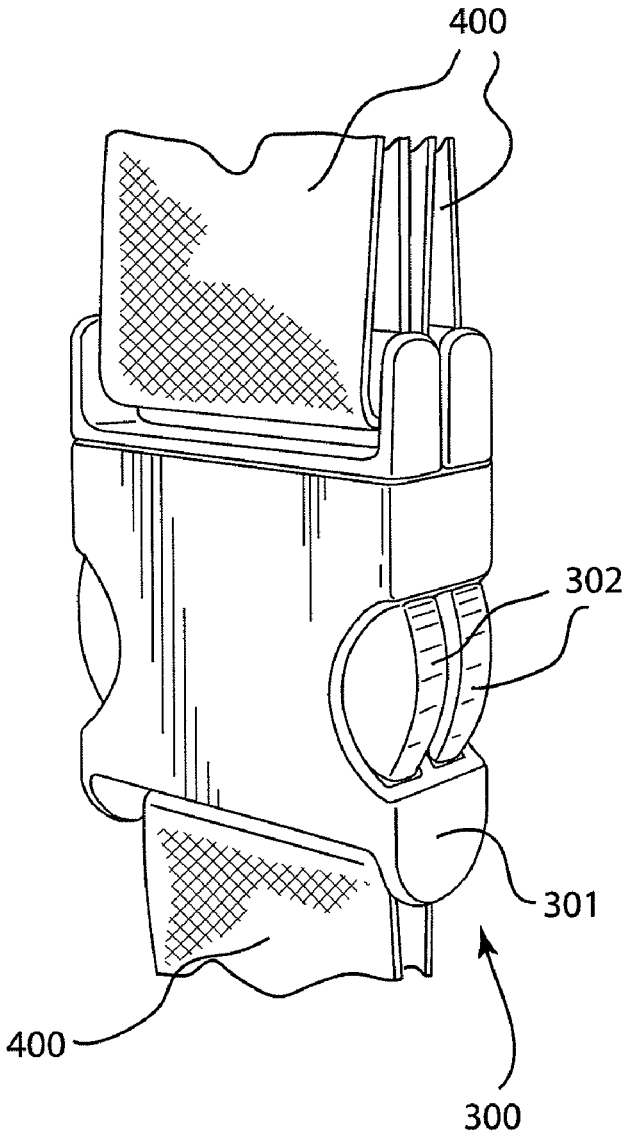
FIG. 8 is a front elevational view of another compound buckle, in accordance with the present invention.
Figure 9:
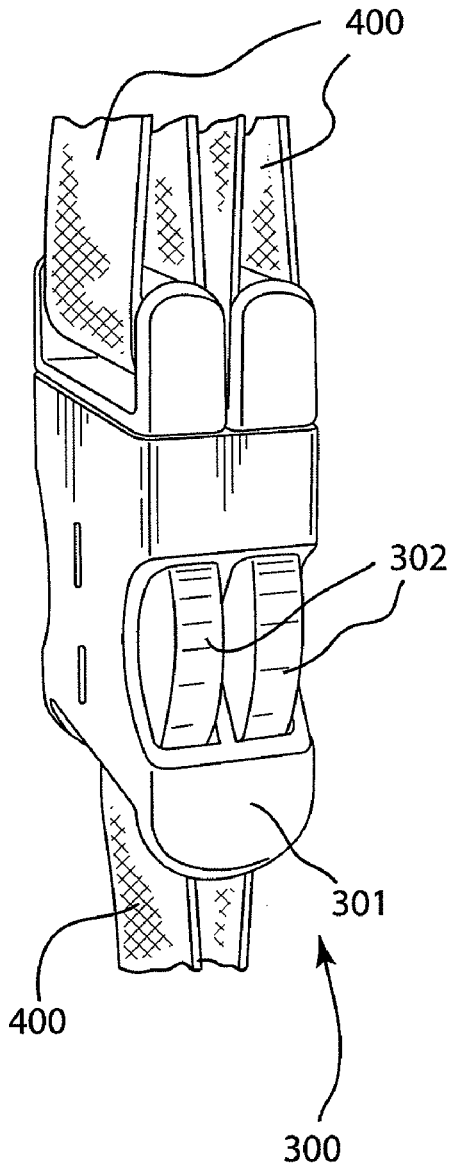
FIG. 9 is a side elevational view of the compound buckle of FIG. 8.

FIGS. 8 and 9 are front and side isometric elevational views, respectively, of compound buckle 300, comprising socket member 301, and plug members 302, from which are connected various straps 400.

Figure 10:
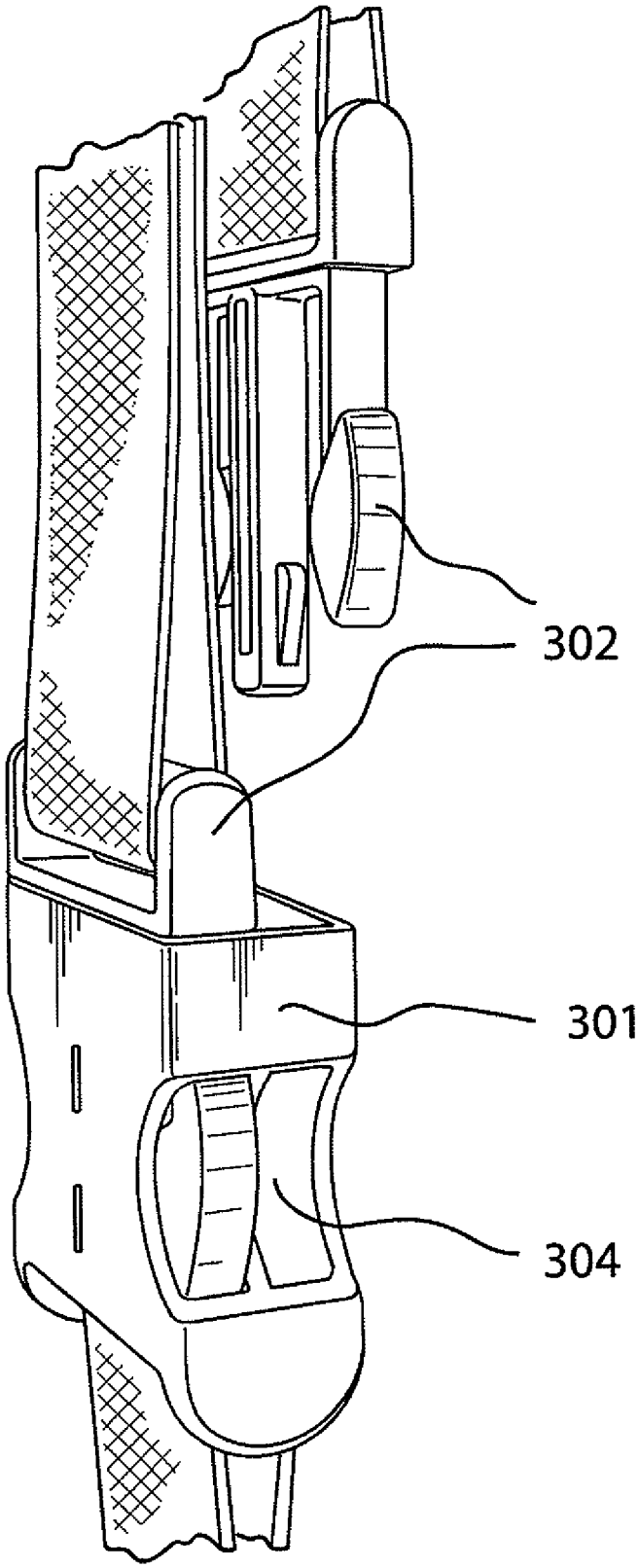
FIG. 10 is a side elevational view of the compound buckle of FIG. 8, shown in a partially disengaged state, in accordance with the present invention.

FIG. 10 details the operation of a first plug member 302, which can be independently disengaged from socket member 301 without interfering with the operation or stability of the remaining plug member 302, and further illustrates the discrete cavities 304 for each of the plug members.

REFERENCE ELEMENT NUMBERS

The following table identifies the objects labeled in the included drawings

| Compound Buckles | |
|---|---|
| 100, 200 and 300 | Compound buckles |
| 101, 201 and 301 | Socket members |
| 102, 103, 202 and 302 | Plug members |
| 104, 204 and 304 | Cavities |
| 400 | Straps/belts |

The invention claimed is:

1. A buckle comprising a single socket member and at least two plug members, said socket member having a base and at least one projecting member projecting from said base which when combined with the base comprises at least one slot through which at least one strap may be affixed, and further, a separate cavity for each plug member, said cavities having a top wall, a bottom wall, and right and left side walls for connecting said top wall and said bottom wall with a gap therebetween and openings communicating with a cavity inside the socket member and disposed inside from said side walls, each said cavity at a different respective vertical plane, such that respective straps, having respective thicknesses less than respective lengths and widths, attached to each plug lie over each other when viewed in the vertical plane in which the cavities are aligned so that the overlying straps have a combined stack thickness of the sum of thicknesses of the two straps, each of said plug members having a base and at least one arm portion projecting from said base, and a projecting member projecting from said base which when combined with the base comprises at least one slot through which at least one strap may be affixed, said arm portion having an engaging portion at a leading end thereof, said plug member being adapted to be resiliently deformed when inserted into/released from said cavity of said socket member so that a hooking face of the engaging portion of said arm portion releasably engages an end face of each of said opening, and further, where the plane of contact between the engaging portion and the end face of the cavity is perpendicular to plane of motion of the insertion/release direction of said arm portion, wherein a first plug member is releasably engageable when inserted into a first cavity of said socket member, and wherein at least one other plug member is releasably engageable when inserted into at least one other cavity of said socket member, and wherein said first and said at least one other plug member are independently operable without affecting insertion and removal of the other.

2. A compound buckle as in claim 1 wherein the operation and/or performance of a strap connected to a first plug member is not affected by the insertion or removal of any other plug member.

3. A buckle as in claim 1 wherein said first plug member and said at least one other plug member are the same.

4. A buckle as in claim 1 wherein said first cavity and said at least one other cavity are substantially parallel to one another.

5. A buckle as in claim 1 wherein said first cavity and said at least one other cavity are substantially stacked vertically on one another.

6. A buckle as in claim 1 wherein said first cavity and said at least one other cavity are positioned side-by-side in substantially the same plane.

7. A buckle as in claim 1 wherein said first cavity and said at least one other cavity stacked one above the other.

8. The buckle of claim 1 wherein straps attached to the respective plugs substantially overlap each other when the respective plugs are inserted into the respective slots.

9. The buckle of claim 7 wherein straps attached to the respective plugs substantially overlap each other when the respective plugs are inserted into the respective slots.

10. The buckle of claim 6 wherein straps attached to the respective plugs substantially overlap each other when the respective plugs are inserted into the respective slots.

* * * * *